US005651706A

United States Patent [19]

Kasper

[11] Patent Number: 5,651,706

[45] Date of Patent: Jul. 29, 1997

[54] COLLAPSIBLE PONTOON PEDAL BOAT

[76] Inventor: Gary A. Kasper, 4926 Timber Ridge Dr., Cadillac, Mich. 49601

[21] Appl. No.: 553,751

[22] Filed: Oct. 23, 1995

[51] Int. Cl.[6] ..... B63H 16/20; B63B 7/08

[52] U.S. Cl. ..... 440/29; 114/61; 114/354

[58] Field of Search ..... 114/61, 353, 354, 114/345, 162, 153, 123; 440/26–31; 474/62

[56] References Cited

U.S. PATENT DOCUMENTS

| | | | |
|---|---|---|---|
| D. 280,498 | 9/1985 | Lacasse | D12/306 |
| D. 290,594 | 6/1987 | Lacasse | D12/306 |
| D. 312,239 | 11/1990 | Down | D12/306 |
| 1,210,783 | 1/1917 | Fay | 474/62 |
| 1,462,800 | 7/1923 | Clemmer | 114/353 |
| 2,912,877 | 11/1959 | Rohrer | 114/153 |
| 2,990,804 | 7/1961 | Garehime . | |
| 3,083,382 | 4/1963 | Havens et al. . | |
| 3,100,100 | 8/1963 | Carpenter | 114/123 |
| 3,204,260 | 9/1965 | Fitzmaurice . | |
| 3,257,987 | 6/1966 | Liard . | |
| 3,594,834 | 7/1971 | Steensen . | |
| 3,812,805 | 5/1974 | Forssell et al. | 114/61 |
| 4,030,562 | 6/1977 | Leighton et al. | 180/34 |
| 4,075,724 | 2/1978 | Hire . | |
| 4,180,881 | 1/1980 | Speranza | 267/41 |
| 4,303,033 | 12/1981 | King | 114/61 |
| 4,364,711 | 12/1982 | Brandt et al. | 416/142 |
| 4,427,392 | 1/1984 | Schneider | 440/30 |
| 4,496,325 | 1/1985 | Tweg | 440/26 |
| 4,511,338 | 4/1985 | Fanelli | 440/29 |
| 4,522,143 | 6/1985 | Holzbaur | 114/344 |
| 4,597,355 | 7/1986 | Kirby | 114/345 |
| 4,648,846 | 3/1987 | Hsu | 440/31 |
| 4,671,202 | 6/1987 | Johnson | 114/353 |
| 4,698,034 | 10/1987 | Anthonijsz | 440/27 |
| 4,744,776 | 5/1988 | Morrison | 440/29 |
| 4,768,454 | 9/1988 | Selken | 114/61 |
| 4,775,187 | 10/1988 | Herr | 297/378 |
| 4,800,832 | 1/1989 | Sulimierski | 114/352 |
| 4,828,517 | 5/1989 | van Liefland | 440/27 |
| 4,891,024 | 1/1990 | Benjamin | 440/28 |
| 4,895,539 | 1/1990 | Bender | 441/135 |
| 4,998,498 | 3/1991 | Gallichan | 114/345 |
| 5,081,947 | 1/1992 | Holden | 114/345 |
| 5,152,703 | 10/1992 | Clement | 440/7 |
| 5,174,232 | 12/1992 | Boddy | 114/61 |
| 5,183,002 | 2/1993 | Parker | 114/353 |
| 5,183,422 | 2/1993 | Guiboche | 440/26 |
| 5,203,276 | 4/1993 | Methven | 114/354 |
| 5,207,306 | 5/1993 | Sato et al. | 192/0.084 |
| 5,217,398 | 6/1993 | Meron et al. | 440/26 |
| 5,248,271 | 9/1993 | Chu | 440/90 |
| 5,257,594 | 11/1993 | Methven | 114/354 |
| 5,282,762 | 2/1994 | Cerreto | 440/30 |
| 5,297,978 | 3/1994 | Ramsey | 441/131 |
| 5,308,268 | 5/1994 | Schmid | 440/30 |
| 5,316,508 | 5/1994 | Landucci | 440/30 |
| 5,353,733 | 10/1994 | Evans | 114/353 |
| 5,362,264 | 11/1994 | Parant | 440/30 |
| 5,374,206 | 12/1994 | Gregory | 440/57 |
| 5,413,066 | 5/1995 | Spencer, Jr. et al. | 114/354 |
| 5,547,406 | 8/1996 | White | 440/30 |

FOREIGN PATENT DOCUMENTS

| | | | |
|---|---|---|---|
| 2120390 | 11/1972 | Germany | 440/29 |

*Primary Examiner*—Sherman Basinger
*Attorney, Agent, or Firm*—Harness, Dickey & Pierce, P.L.C.

[57] ABSTRACT

A watercraft comprising a body, two inflatable floatation members, a drive assembly, a steering assembly and a seat wherein the body portion of the watercraft is foldably collapsible from an operative configuration to a transportable configuration. When in its transportable configuration, the watercraft body forms a compact storage case adapted to accommodate all of the elements of the watercraft for easy and convenient transportation. The storage case generally includes a first compartment wherein the drive assembly and seat are stored and a second compartment accommodating the floatation members and other miscellaneous components of the watercraft.

20 Claims, 7 Drawing Sheets

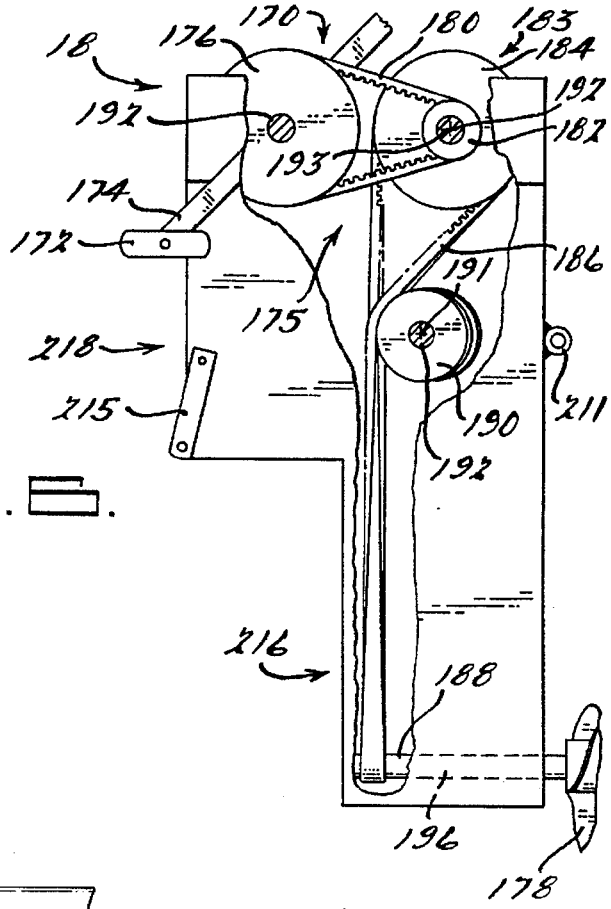
FIG. 6.
FIG. 7.
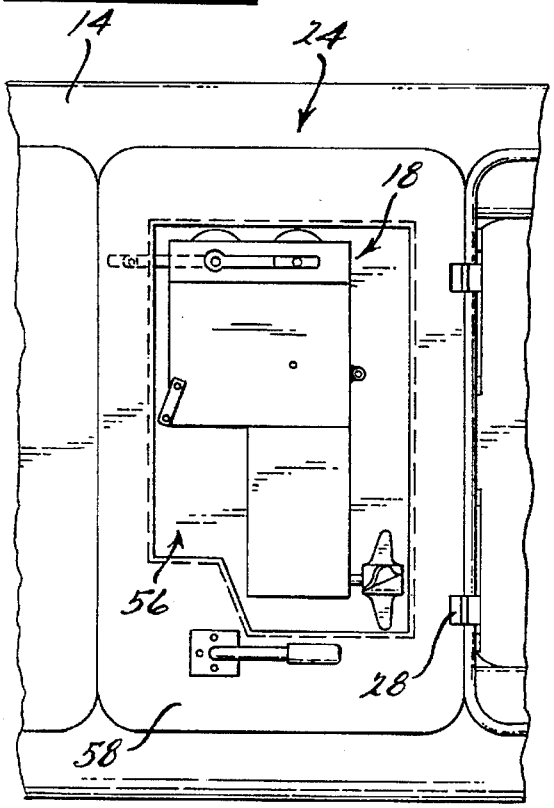
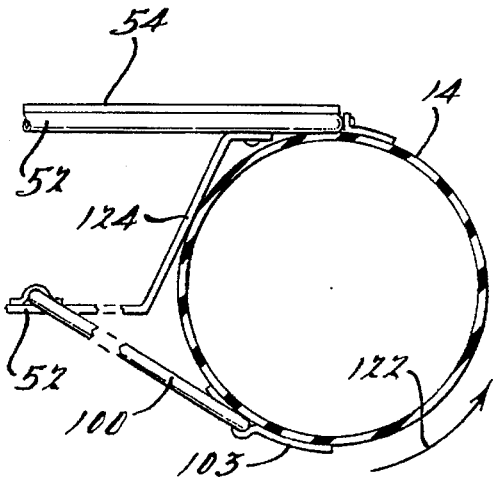
FIG. 5.

COLLAPSIBLE PONTOON PEDAL BOAT

BACKGROUND OF THE INVENTION

The present invention generally relates to a pedal operated watercraft and, more particularly, to a pedal powered watercraft that collapses into a transportable carrying case containing all the elements of the watercraft.

Personal watercrafts, especially those designed to seat one or two individuals, have become increasingly popular. Commonly, watercraft of this nature are propelled by human or mechanical means, incorporate a variety of floatation devices and disclose multiple variations in frame and platform design. These crafts are used in recreational activities such as fishing and as an alternative form of exercise. Since the watercraft must be transported by motor vehicle, it is imperative that the watercraft be constructed to enable quick and easy assembly and disassembly into a compact package that can be easily transported within a vehicle or on an article carrier secured to a roof or deck lid of a vehicle. Otherwise, the need arises for the use of a trailer to transport the watercraft adding significant overall expense to the watercraft, as well detracting from the ease and convenience of operating the motor vehicle.

In order to increase the useability and provide easier assembly, manufacturers have attempted to develop watercraft that are increasingly transportable and lightweight. However, while recent watercraft disassemble for easier and more compact transportation and storage, the prior art has failed to provide consumers with a boat that collapses to form a carrying case wherein all of the elements of the craft are secured for transportation or storage. Existing watercraft, while capable of being disassembled, often require time consuming assembly procedures. Such existing watercraft also typically include a large number of independent component parts which are more likely to be misplaced or lost during storage of the watercraft. Thus, a need exists for such a collapsible, self-contained watercraft that is extremely compact so as to be easily transportable by a vehicle without the need for a trailer, lightweight, and easily assembled with relatively few assembly steps.

SUMMARY OF THE INVENTION

An object of the present invention is to provide a pedal powered watercraft collapsible from an operative position to a transportable position wherein the body of the boat forms a carrying case securely containing all the elements of the boat for transportation.

An additional object of the present invention is to provide a collapsible, self-contained watercraft having a plurality of substantially rigid sections adapted to form a platform in a first position and a carrying case in a second position wherein all of the elements of the boat may be secured for transportation.

A further object of the present invention is to provide a pedal powered drive mechanism for use with a collapsible watercraft. The drive mechanism includes a pedal mechanism, a propeller and a power transfer apparatus adapted to efficiently transfer power from the pedal mechanism to the propeller while being sufficiently small in size so as to fit within the collapsed boat.

Accordingly, the present invention provides a pedal powered watercraft having a body portion consisting of a plurality of frame and platform sections connected to and separating a pair of inflatable floatation members. The body provides support for a chair, a steering device and a pedal powered drive mechanism operative by an individual sitting in the chair. The plurality of sections forming the body of the boat collapse to form a carrying case wherein the steering mechanism, chair, drive mechanism and floatation members are secured for transportation.

The collapsible pedal boat described herein is easily assembled for use and disassembled for transportation and storage. All of the elements of the boat are contained within the collapsed body portion when the body is in its transportable configuration. When in its transportable configuration, the pedal boat is easily transportable within or on top of a vehicle, thereby obviating the need for a trailer. The improved watercraft thus provides a compact yet efficient pedal-powered apparatus.

BRIEF DESCRIPTION OF THE DRAWINGS

The objects and features of this invention will become further apparent from a reading of the following detailed description taken in conjunction with the drawings, in which:

FIG. 6 is a side view of a preferred embodiment of the drive assembly of the collapsible boat;

FIG. 7 is a top view of a portion of the boat showing the boat in its beginning stage of collapse illustrating the drive mechanism disposed in its stored position;

FIG. 8 is a top view of the boat partially collapsed and overturned such that the bottom of the boat is shown.

DETAILED DESCRIPTION OF A PREFERRED EMBODIMENT

Figure 1:
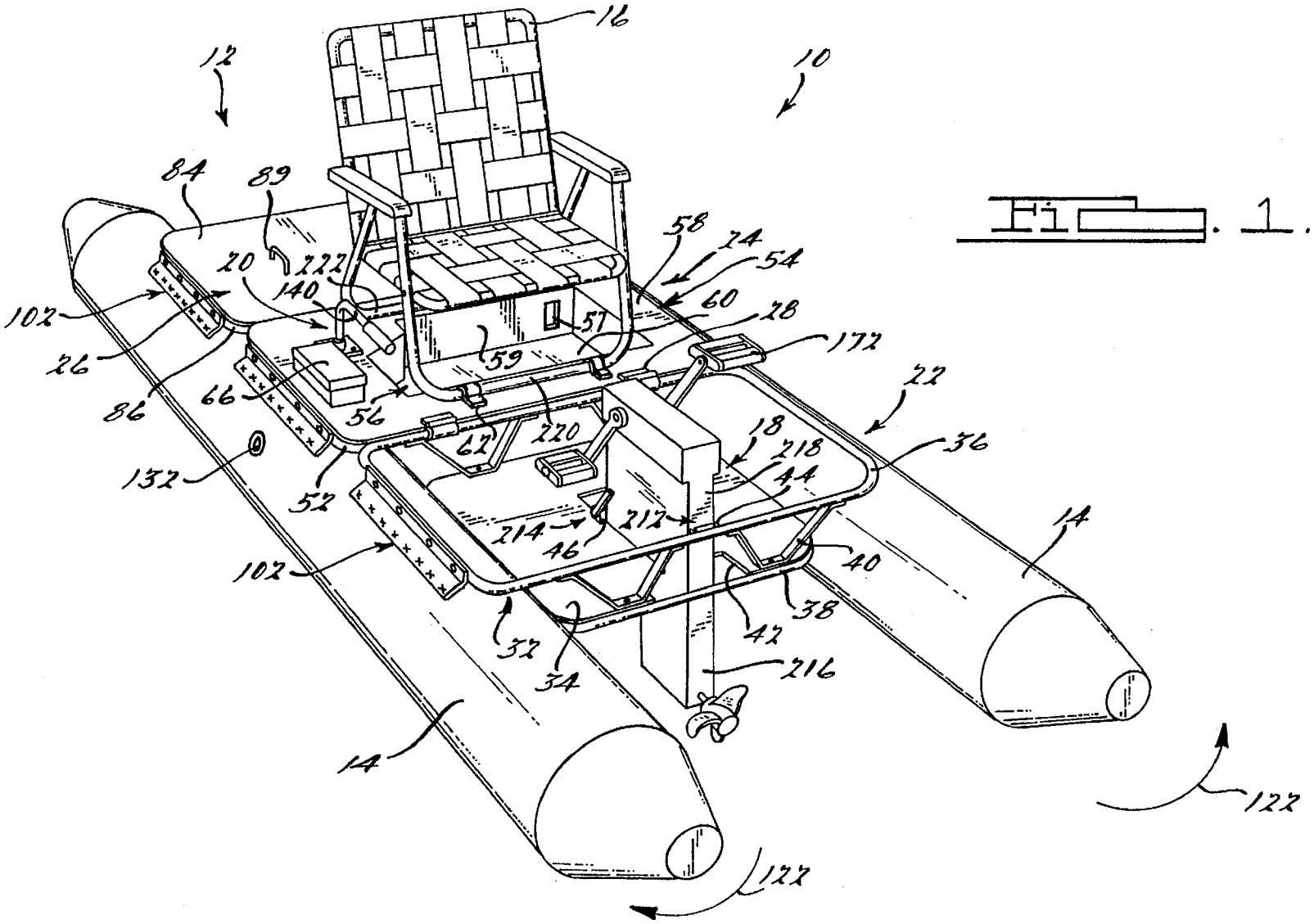
FIG. 1 is a perspective view of the collapsible boat in its operative position.

FIGS. 1, 2, 3 and 4 illustrate collapsible boat 10 in its operative condition wherein one or more individuals may operate the boat on a lake or other water surface. In this embodiment, a body 12 is connected to and separates a pair of floatation members 14 and supports a seat 16, a drive assembly 18 and a steering apparatus 20. Body 12 includes a plurality of interconnected platform sections operative to form a platform when in a first operative configuration and a carrying case when in a second collapsed configuration. It is preferred that body 12 include a front section 22, a center section 24 and a rear section 26 wherein center section 24 is hingeably connected to front and rear sections 22, 26 by hinges 28 and 30, respectively.

As best seen in FIG. 1, each section of body 12 is generally comprised of a frame connected to and supporting a generally planar platform. Front section 22 includes a frame 32 and a platform 34 connected to frame 32 by screws or other suitable fasteners (not shown). Frame 32 generally includes an upper section 36 and a lower section 38 preferably formed of an aluminum conduit or other appropriate lightweight material. Upper and lower sections 36, 38 are interconnected by support members shown as diagonally disposed V-shaped brackets 40. Platform 34, as well as the platforms for center and rear sections 24 and 26, is preferably formed of molded fiberglass or vacuum formed plastic. Front platform 34 is shown to include a T-shaped aperture 42 that provides for the removable connection of drive assembly 18 to front section 22 as hereinafter described. Drive assembly mounting brackets 44, 46, located on frame 32 and platform 34, respectively, cooperate with a tube and pin connecting apparatus 212 and pivoting U-shaped latch connecting apparatus 214, respectively, located on drive assembly 18.

Figure 2:
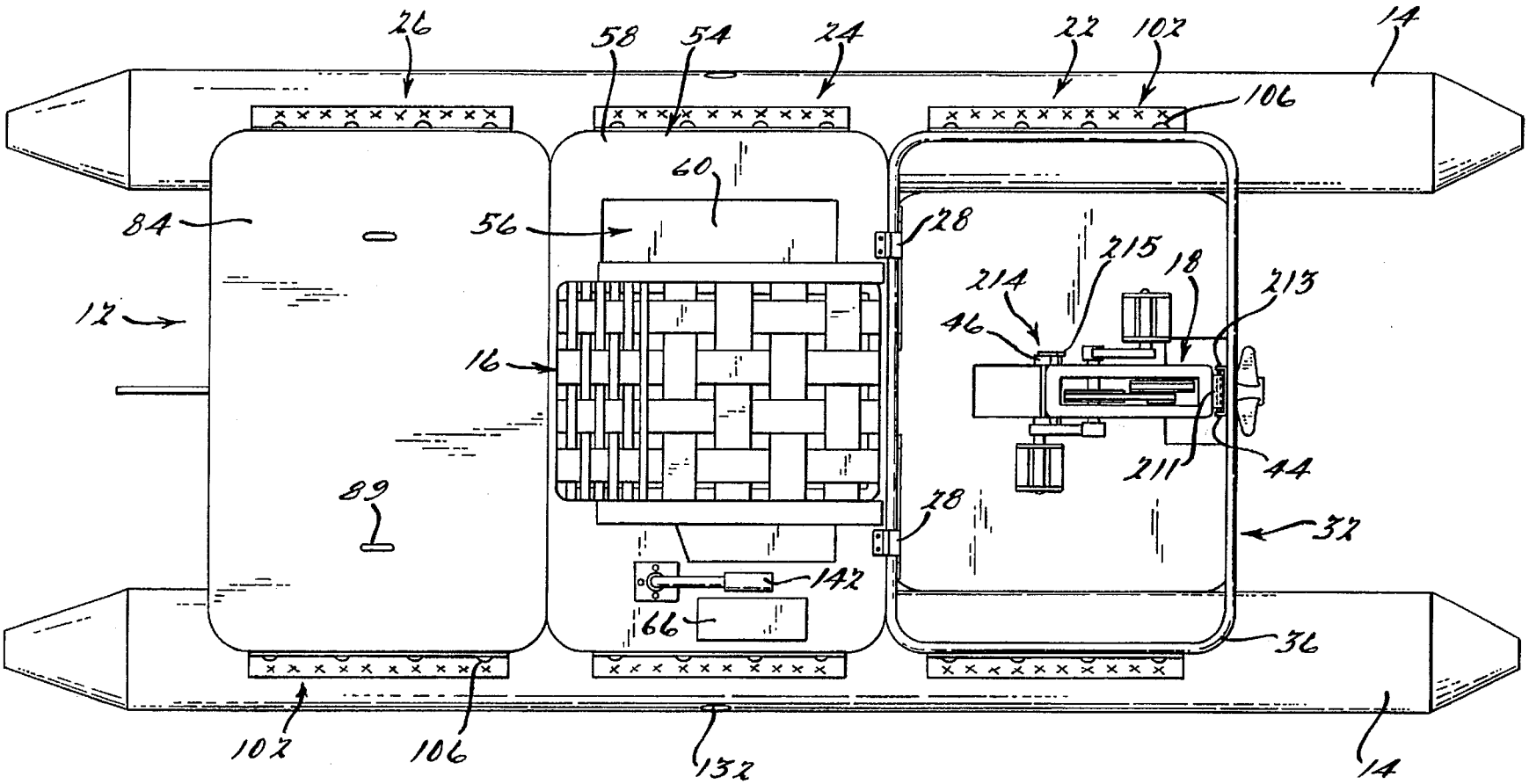
FIG. 2 is a top view of the collapsible boat shown in FIG. 1.

It should be noted that platform 34 of front section 22 is lower than platform 54 of center section 24. The difference in elevation, as best seen in FIG. 2, provides additional foot or leg clearance between pedals 172 and front platform 34. Further, the elevation difference allows drive assembly 18 to sit closer to the water than if platform 34 were on the same level as center platform 54 thereby reducing the overall height of drive assembly 18 and allowing drive assembly 18 to be stowed within a compartment formed by front section 22 and center section 24 as hereinafter described.

Figure 4:
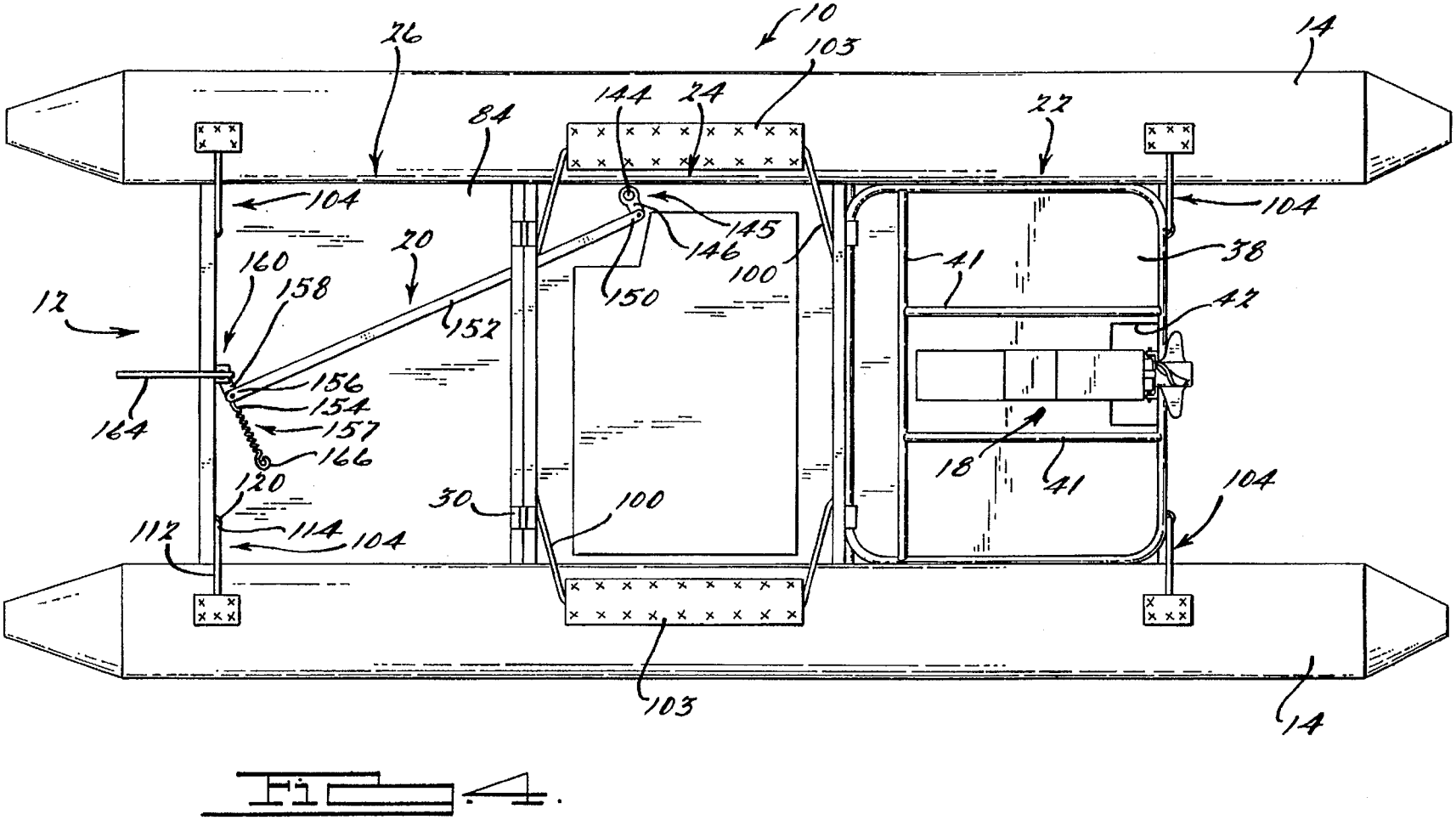
FIG. 4 is a bottom view of the collapsible boat shown in FIG. 1.

Finally, regarding the structure of front section 22, a plurality of support members 41 are shown in FIG. 4 to be connected to lower frame section 38. Support members 41 provide front section 22 with additional strength to support drive assembly 18. It is contemplated that support members 41 may not be necessary if platform 34 has a sufficient thickness or is formed of a material of sufficient strength to support the loading adjacent T-shaped aperture 42.

Center section 24 also includes a frame 52 supporting a platform 54 having a depression 56 sized to accommodate drive assembly 18 when boat 10 is collapsed. As a result, center section 24 includes an upper planar surface 58 and a lower planar surface 60. An aperture 57 is formed in the rear side wall 59 of depression 56 to accommodate a pedal 172 of drive assembly 18 as will be hereinafter described. It is contemplated that a plurality of brackets 62 may be connected to upper planar surface 58 of platform 54 to allow seat 16 to be connected to platform 54 in various positions relative to drive assembly 18 thereby more comfortably accommodating individuals of various height.

Seat 16 is shown as a standard foldable lawnchair removably connected to center platform 54 via seat mounting bracket 62. However, it is contemplated that a variety of seating mechanisms including a beach-type chair may be substituted without departing from the spirit of the invention. It is preferred that rear support 222 of seat 16 remain attached to center platform 54 by brackets (not shown) when collapsible boat 10 is in both its operative and collapsed configurations.

A mounting apparatus (not shown) may be included on upper planar surface 58 of center platform 54 to mount and secure a tote box 66 or other storage container on upper surface 58. It will be appreciated that various means may be used to secure tote box 66 to platform 54 such as by straps, clips or movable brackets. Finally, as will be discussed in greater detail hereinafter, tiller 140 of steering apparatus 20 passes through upper planar surface 58 of center platform 54 thereby allowing an individual in seat 16 to control the direction of travel of collapsible boat 10.

Figure 3:
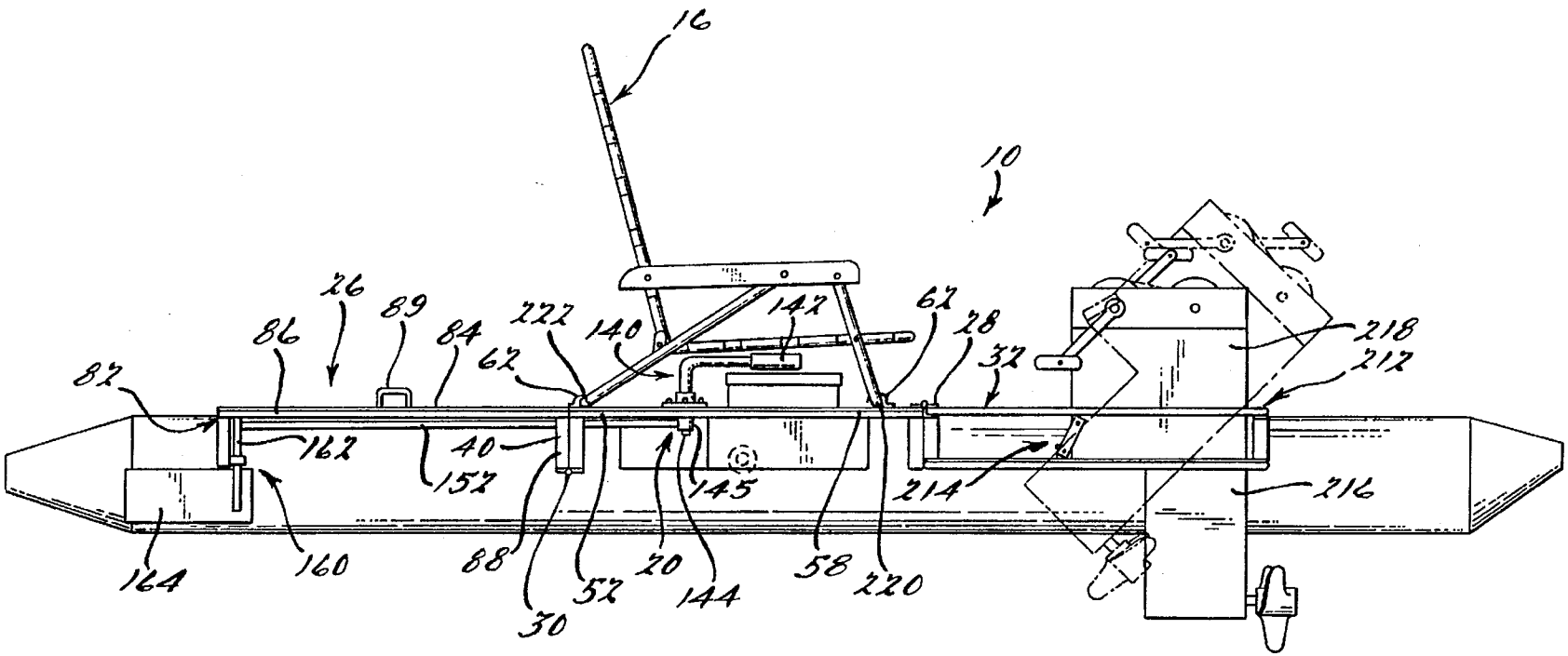
FIG. 3 is a right side view of the collapsible boat shown in FIG. 1 with the right floatation member removed for clarity.

Center section 24 is connected to front section 22 via front hinges 28 and to rear section 26 by rear hinges 30. As best seen in FIG. 3, front hinges 28 connect front frame 32 to upper planar surface 58 of center section 24 thereby allowing front section 22 to pivot relative to center section 24 in a counterclockwise direction. Rear hinges 30 connect rear section 26 to center frame 52 thereby permitting rear section 26 to pivot relative to center section 24 in a counterclockwise direction.

Rear section 26 includes a platform 84 and a frame 82 having an upper section 86 and V-shaped brackets 40 (FIG. 3) forming a lower frame section 88 connected to rear hinges 30. Rear platform 84 may be used as a storage area and may be provided with straps, clips or other means such as brackets 89 for securing a cooler or other container (not shown) thereto. It should be appreciated that rear platform 84 may include means for connecting a passenger seat or removable motor thereto.

Figure 5:
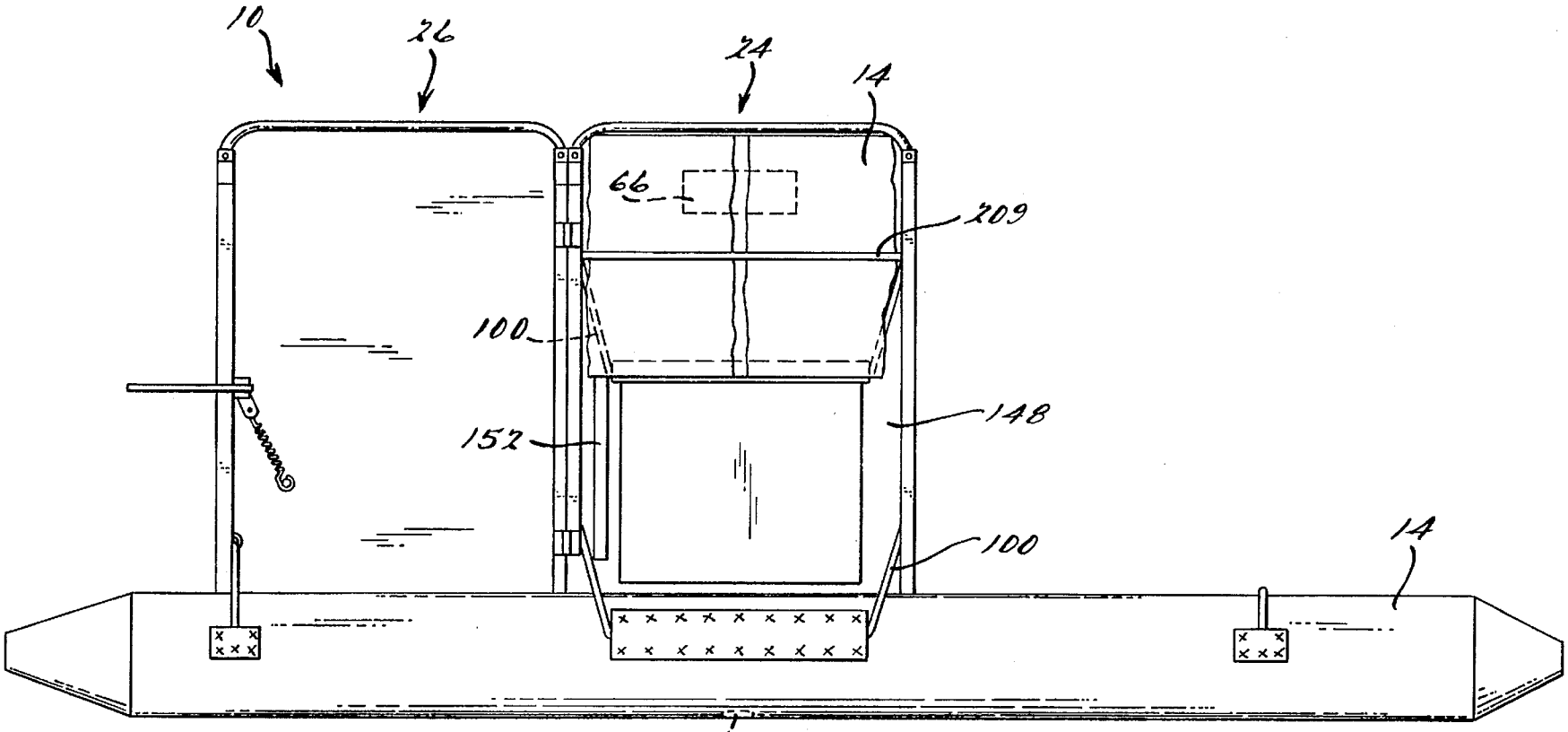
FIG. 5 is a detailed end view of the connection of the floatation members to the center section of the collapsible boat.

With reference to FIGS. 4 and 5, a pair of floatation members 14 are shown connected to body 12. While floatation members 14 may be removably connected to body 12, it is preferred that floatation members 14 be permanently connected to center section 24 by pivoting mounting members 100 and removably connected to front and rear sections 22, 26 by mounting flaps 102 (FIGS. 1 and 2) and straps 104 (FIG. 4). Pivoting mounting members 100 are preferably elongated U-shaped members (FIG. 5) pivotably connected to frame 52 of center section 24 and permanently connected to floatation members 14 by an appropriate fastener such as glued flap 103.

As best seen in FIG. 2, mounting flaps 102, preferably formed of the same material as floatation member 14, are permanently affixed to floatation members 14 by glue or other appropriate method. Snaps 106 or other suitable fasteners are included on mounting flaps 102 and on front and rear frames 32, 82 so as to removably secure front and rear sections 22, 26 to floatation members 14 when collapsible boat 10 is in its first operative position. Mounting straps 104 (FIG. 4) include a strap portion 112 sewn into, glued or otherwise permanently attached to floatation members 14 and a hook 114. Each hook 114 cooperates with a mounting eye 120 connected to front and rear sections 22, 26 to secure floatation members 14 to body 12. It will be appreciated that mounting flaps 102 and mounting straps 104 cooperate to prevent floatation members 14 from rotating about their longitudinal axis in a direction shown by arrows 122 (FIGS. 1 and 5). Front, center and rear sections 22, 24 and 26 are further provided with a plurality of brackets 124 (FIG. 5) that prevent floatation members 14 from rotating about their longitudinal axis in a direction opposite that shown by arrows 122 (FIG. 5). It will be appreciated by one skilled in the art that a variety of other methods are available to securely connect floatation members 14 to body 12.

Floatation members 14 include a pair of inflatable tubes each having a valve 132 for inflating and deflating the tube. Valves 132 are shown proximate to the center of the inflatable tubes so as to efficiently inflate and deflate the tubes. It is preferred that the tubes are comprised of a flexible, fabric reinforced, puncture resistant material such as hypolon. A portable pump 134 (FIG. 9) is included with collapsible boat 10 to allow an individual to inflate floatation members 14 when the boat is placed in its first operative position as shown in FIGS. 1–4.

As best seen in FIGS. 3 and 4, steering apparatus 20 allows an individual to control the direction of travel of collapsible boat 10. Steering apparatus 20 includes a tiller 140, a linkage bar 152, a spring 157 and a rudder assembly 160. Tiller 140 includes a first end 142 operative as a handle and a second end 144 connected to a hub 145 having an arm 146. Hub 145 is secured to the underside of center platform 54 for rotation with second end 144 of tiller 140. First end 150 of linkage bar 152 is connected to arm 146 by a pin (not shown). Second end 156 of linkage bar 152 and first end 154 of spring 157 are each connected to a bracket 158 mounted on a rudder assembly 160. A rod 162 (FIG. 3) connects bracket 158 to a rudder blade 164. Second end 166 of spring 157 is connected to the underside of rear platform 84 thereby allowing spring 157 to bias rudder blade 164 into a position parallel to the longitudinal axis of collapsible boat 10. Spring 157 ensures that, absent rotation of tiller 140, collapsible boat 10 travels in a straight direction. It will be appreciated by those skilled in the art that rotation of first end 142 of tiller 140 causes rotation of arm 146, linear movement of linkage bar 152, axial stretching of spring 157 and rotation of rudder blade 164 thereby allowing the individual on the boat to control the boat's direction of travel.

Turning now to the propulsion of collapsible boat 10, it is contemplated that either a mechanically or pedal powered mechanism could be used. In a preferred embodiment, pedal powered drive assembly 18 is removably mounted within a T-shaped aperture 42 formed in platform 34 of front section 22. As best seen in FIG. 6, drive assembly 18 includes a lower housing portion 216 and an upper housing portion 218 that together enclose a power transfer apparatus 175 that transfers rotational movement of pedal apparatus 170 to propeller 178.

With reference to FIG. 1, upper housing portion 218 preferably is larger than lower housing portion 216 so that drive assembly 18 may be supported in its operative position by front platform 34 adjacent to T-shaped aperture 42. When so disposed, connecting apparatuses 212 and 214 releasably connect drive assembly 18 to front section 22 of body 12. More specifically, as shown in FIG. 2, a tube 211, permanently affixed to upper housing portion 218, and a pin 213 cooperate with U-shaped mounting bracket 44 to releasably connect drive assembly 18 to frame 32 of front section 22 and a U-shaped latch 215 pivotably connected to upper housing portion 218 cooperates with brackets 46 to releasably connect drive assembly 18 to platform 34 of front section 22.

As is known, rear connecting apparatus 214 or another suitable fastener may be adapted to disengage when subjected to a predetermined force. As shown in phantom in FIG. 3, when lower portion 216 of drive assembly 18 encounters a submerged obstruction, rear connecting apparatus 214 is adapted to release drive assembly 18 thereby allowing drive assembly 18 to pivot about front connecting apparatus 212 to allow collapsible boat 10 to pass over the obstruction. This feature minimizes damage to the propeller and drive mechanism caused by submerged obstructions and is especially advantageous when landing collapsible boat 10 on a beach.

As best seen in FIG. 6, pedal apparatus 170 of drive assembly 18 generally includes pedals 172, pedal arms 174 and drive pulley 176. Propeller 178 is mounted on a shaft 196 and operationally connected to pedal apparatus 170 by power transfer apparatus 175. As is hereinafter described, the preferred power transfer apparatus includes a two step belt and pulley arrangement. However, those skilled in the art will appreciate that other methods of transferring rotational energy from pedal apparatus 170 to propeller 178 are available and within the scope of this invention.

With continued reference to FIG. 6, power transfer apparatus 175 preferably includes first and second belts 180, 186, a reduction pulley 183 including a reduced radius pulley 182 and an enlarged radius pulley 184, an idler pulley 190 and a driven pulley 188 connected to propeller shaft 196. First belt 180 connects drive pulley 176 to reduced radius pulley 182 and second belt 186 connects enlarged radius pulley 184 with driven pulley 188. Idler pulley 190 contacts and twists second belt 186 ninety degrees (90°) to rotationally engaged driven pulley 188. The axis of rotation of driven pulley 188 is substantially perpendicular to that of drive pulley 176, reduced radius-pulley 182 and enlarged radius pulley 184. Pulleys 176, 182, 184 and 190 each rotate about rods 192 connected to a drive assembly housing 194.

It will be appreciated that driven pulley 188 has a reduced radius relative to pulleys 176 and 184. As a result of the difference in radius between reduced radius pulley 182 and large radius pulley 176 and 184, second belt 186 connecting enlarged radius pulley 184 to driven pulley 188 has a greater linear velocity than first belt 180. Further, as a result of the difference in radius between driven pulley 188 and enlarged radius pulley 184, driven pulley 188 has an angular velocity greater than that of enlarged radius pulley 184. It is preferred that this two-step timing belt and pulley arrangement provide a gear reduction ratio of approximately 10 to 1.

It is further preferred that the aforementioned pulleys and belts have a tooth and groove arrangement providing increased engagement surfaces for transferring rotational energy. Idler pulley 190 provides a 90° twist to second belt 186 and pulls second belt 186 more closely in line with the entrance side of driven pulley 188. Idler pulley 190 defines an axis of rotation 191 that is set at an acute angle relative to an axis 193 of pulley 184 and the axis of rotation of driven pulley 188 such that the entrance point of idler pulley 190 aligns with the exit point of enlarged radius pulley 184 and its exit point aligns with the entrance point of driven pulley 188.

It is preferred that the drive mechanism pulleys be comprised of a molded or formed plastic or other lightweight material. However, it will be appreciated by those skilled in the art that not only may other materials be used to form the pulleys but a plurality of gears and rods may also be used to transmit rotational energy from pedal apparatus 170 to propeller 178.

Figure 9:
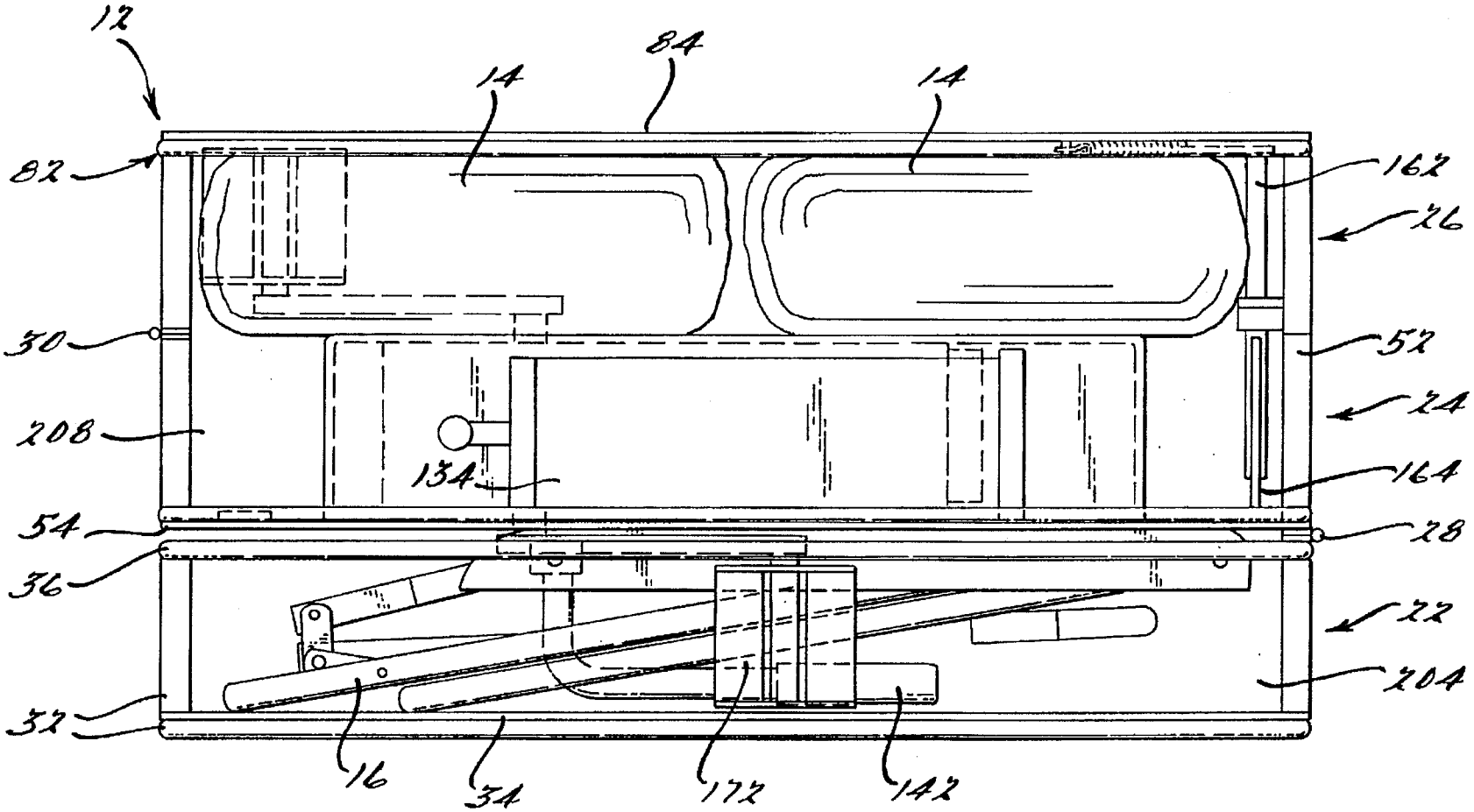
FIG. 9 is a view of the boat in its fully collapsed condition.

As previously discussed, collapsible boat 10 folds into a second transportable configuration wherein body 12 forms a carrying case adapted to contain all of the elements heretofore disclosed. FIGS. 7–9 illustrate collapsible boat 10 in various stages of its transformation from its first operating configuration to its second transportable configuration. With reference to FIGS. 1 and 3, transformation of collapsible boat 10 into its transportable configuration begins with the removal of drive assembly 18 from T-shaped aperture 42. Front support 220 of seat 16 is then removed from brackets 62 and seat 16 is pivoted counterclockwise toward rear section 26 of body 12 thereby providing access to depression 56 formed in center platform 54. The lowermost pedal of drive assembly 18 is placed through aperture 57 formed in the rear wall 59 of depression 56 thereby allowing drive assembly 18 to rest substantially within depression 56 (FIG. 7). Once so disposed, drive assembly 18 and, more specifically, pedals 172, pedal arms 174 and propeller 178 are properly oriented within depression 56 so as to permit seat 16 to be rotated clockwise about rear support 222 until seat 16 is disposed above drive assembly 18.

After drive assembly 18 and seat 16 are properly disposed, front section 22 of body 12 is released from floatation members 14 by disengaging snaps 106 and mounting straps 104. Front section 22 is then pivoted substantially one hundred and eighty degrees (180°) about front hinges 28 in a counterclockwise direction (FIGS. 2 and 4) until upper frame 36 contacts upper planar surface 58 of center platform 54 (FIG. 9). Front and center sections 22, 24 are then secured to one another such as by C-clips (not shown). It will be appreciated that when properly disposed, front section 22 cooperates with center section 24 to define a first storage compartment 204 bounded by front and center frames 32, 52, front platform 34 and Center platform 54 including depression 56. It will further be appreciated that seat 16 is disposed within first compartment 204 between tiller handle 142 and the uppermost pedal 172 of pedal apparatus 170.

The transition of collapsible boat 10 from its first operative position to its second transportable position is continued by overturning collapsible boat 10 such that the underside of front section 22 contacts the surrounding ground as shown in FIG. 8. At this stage, first and second ends 150 and 156 of linkage bar 152 (FIG. 4) are disconnected from hub arm 146 and connecting bracket 158, respectively, by removing J-pins or other suitable fasteners (not shown). Linkage bar 152 is then disposed on the underside 148 of center section 24 and floatation members 14 are deflated through valve 132 and prepared for storage within second storage compartment 208. As best seen in FIG. 9, second storage compartment 208 is defined by center and rear frames 52, 82, center platform 54 and rear platform 84.

As best seen in FIG. 8, pivoting mounting members 100 are pivoted into their collapsed position and each half of each floatation member is then rolled toward center valve 132 beginning at the most forward and rearward portions. Once substantially all of the air is expelled from floatation members 14, floatation members 14 are secured within second storage compartment 208 by straps 209 or other suitable means.

As shown in FIG. 9, rear section 26 is then rotated substantially one hundred and eighty degrees (180°) about rear hinges 30 in a counterclockwise direction until the lower frame of rear section 26 contacts the lower frame of center section 24 thereby forming second storage compartment 208. It should be noted that, to properly secure rear section 26 to center section 24, rudder blade 164 must be rotated 90° and disposed within second compartment 208 adjacent to center frame 52. In order to so orient rudder blade 164, it will be appreciated that rod 162 of rudder assembly 160 is disposed forward of the rearmost portion of rear frame 82. Air pump 134 (FIG. 9) and tote box 66 (FIG. 8) may be disposed within second storage compartment 208 adjacent depression 56.

After rear section 26 is properly disposed above center section 24, C-clips or other suitable fasteners are used to secure rear section 26 to center section 24 and collapsible boat 10 is entirely transformed into its second transportable position. In this position, front section 22, center section 24, and rear section 26 are in a substantially stacked arrangement as illustrated in FIG. 9 whereby body 12 forms first and second storage compartments 204 and 208 containing drive assembly 18, seat 16, steering apparatus 20, tote box 66, pump 134 and floatation members 14. The dimensions of body 12 are such that the entire collapsible boat 10 may be transported in the back of a van, on a car top carrier, within a back seat of an automobile or in large car trunks. Specifically, it is preferred that the storage case formed by collapsible boat 10 has dimensions no larger than about 24"×36"×15" thereby allowing collapsible boat 10 to be shipped by the United States Parcel Service or other conventional means. Advantageously, since the entire collapsible boat 10 is collapsible into a self-contained assembly there is no risk for misplacing or losing a major subcomponent, or of forgetting to bring a subcomponent when the owner/operator initially loads the boat 10 into a vehicle and departs his/her residence, or loads the boat 10 into his/her vehicle after collapsing the boat 10.

Various other advantages and modifications will become apparent to one skilled in the art after having the benefit of studying the teachings of the specification, the drawings and the following claims.

What is claimed is:

1. A watercraft collapsible from an operative configuration to a compact, transportable configuration, said watercraft comprising:

a body including front, center and rear sections, said front and rear sections pivotally connected to said center section and rotatable substantially one hundred eighty degrees relative to said center section from a first position wherein said body forms a deck when said watercraft is in said operative configuration to a second position wherein the front, center, and rear sections are disposed in a substantially stacked arrangement whereby said body forms a storage case when said watercraft is in said transportable configuration;

at least two inflatable floatation members connected to said body, said floatation members being containable within said storage case when said watercraft is in said transportable configuration;

a drive assembly removably connected to said front section of said body when said watercraft is in said operative configuration and containable within said storage case when said watercraft is in said transportable configuration; and a steering assembly connected to said body when said watercraft is in said operative configuration and containable within said storage case when said watercraft is in said transportable configuration.

2. The watercraft of claim 1 wherein said front, rear and center sections of said body each include a frame connected to a platform, said frames and platforms of said front section and said center section forming a first storage compartment of said storage case when said watercraft is in said transportable configuration, said frames and platforms of said rear section and said center section forming a second storage compartment of said storage case when said watercraft is in said transportable configuration.

3. The watercraft of claim 2 wherein said platforms of said rear and center sections cooperate to form an upper level of said deck and said platform of said front section forms a lower lever of said deck when said watercraft is in said operative configuration.

4. The watercraft of claim 2 further comprising a seat connected to said body, said seat movable from a first position wherein said seat is operable to allow an individual to sit therein when said watercraft is in said operative configuration to a second position wherein said seat is contained within said storage case when said watercraft is in said transportable configuration.

5. The watercraft of claim 4 wherein said floatation members are contained within said second compartment of said storage, case and said drive assembly and said seat are substantially contained within said first storage compartment of said storage case when said watercraft is in said transportable configuration.

6. The watercraft of claim 1 wherein said floatation members are permanently affixed to said center section and wherein said floatation members are removably connected to said front section and said rear section of said body when said body is in said operative configuration.

7. The watercraft of claim 1 further including an opening formed in said deck, and wherein said drive assembly includes a propeller, said drive assembly extending through said opening and removably connected to said deck adjacent to said opening when said body is in said operative configuration.

8. The watercraft of claim 7 wherein said opening comprises a T-shaped opening, wherein said drive assembly includes an upper portion and a lower portion, wherein said propeller is connected for rotation with a shaft extending from said lower portion and wherein said upper portion contacts said deck adjacent said T-shaped opening and said lower portion extends through said opening when said watercraft is in said operative configuration.

9. The watercraft of claim 1 wherein said drive assembly includes a housing, a pedal apparatus connected to said housing for rotation relative thereto, a plurality of pulleys connected to said housing for rotation relative thereto and a belt operative to rotate said propeller in response to rotation of said pedal apparatus.

10. The watercraft of claim 9 wherein said pedal apparatus includes a drive pulley and wherein said drive assembly further includes a first driven pulley and a second driven pulley connected to said housing for rotation relative thereto, said second driven pulley connected for rotation with said propeller, a first belt connecting said drive pulley to said first driven pulley, a second belt connecting said first driven pulley to said second driven pulley.

11. The watercraft of claim 10 wherein said drive assembly further includes an idler pulley connected to said housing for rotation relative thereto, said idler pulley contacting said second belt and operative to rotate said second belt such that the axis of rotation of said propeller is substantially perpendicular to the axis of rotation of said drive pulley and said first driven pulley.

12. The watercraft of claim 1 wherein said steering assembly includes a rudder, means for rotating said rudder and means for biasing said rudder into a position parallel to the longitudinal axis of said body.

13. The watercraft of claim 1 wherein said storage case has dimensions of about 24 inches by 36 inches by 15 inches.

14. A watercraft collapsible from an operative position to a transportable position, said watercraft comprising:

a body including a front section, a center section and a rear section, said front section and said rear section pivotably connected to said center section and movable from a first position wherein said body forms a deck to a second position wherein said body forms a storage case having a first compartment formed by said front and center sections and a second compartment formed by said rear and center sections, said front section including a platform having an opening;

two inflatable floatation members separated by and connected to said center section, said floatation members removably coupled to said front and rear sections when said watercraft is in said operative position, said floatation members contained within said second compartment of said storage case when said watercraft is in said transportable position;

a drive assembly including a pedal apparatus and a propeller coupled to a drive assembly housing for rotation relative thereto, said pedal apparatus operative to rotate said propeller, said drive assembly removably disposed within said opening in said front section when said watercraft is in said operative position, said drive assembly contained within said first compartment of said storage case when said watercraft is in said transportable position;

means for steering said watercraft including a rudder pivotably connected to said body; and a seat connected to said center section of said body, said seat contained within said first compartment of said storage case when said watercraft is in said transportable position.

15. The watercraft of claim 14 wherein said means for steering further includes a tiller and a linkage bar, said tiller pivotably connected to said center section, said rudder pivotably connected to said rear section, said linkage bar interconnecting said tiller and said rudder when said watercraft is in said operative position whereby rotation of said tiller operates to rotate said rudder, said linkage bar contained within said second compartment of said storage case when said watercraft is in said transportable position.

16. The watercraft of claim 14 wherein said drive assembly further includes a drive pulley coupled for rotation with said pedal apparatus, a reduction pulley, a driven pulley coupled for rotation with said propeller and an idler pulley cooperatively disposed between said reduction pulley and said driven pulley, a first drive belt operationally connecting said drive pulley and said reduction pulley, a second drive belt operationally connecting said reduction pulley and said driven pulley, said reduction pulley, drive pulley, driven pulley and idler pulley connected to said drive assembly housing for rotation relative thereto.

17. The watercraft of claim 14 further including an air pump operative to inflate said two inflatable floatation members, said air pump contained within said second compartment of said storage case when said watercraft is in said transportable position.

18. The watercraft of claim 14 further including a tote box contained within said second compartment of said storage case when said watercraft is in said transportable position.

19. A pedal powered drive mechanism for use in a collapsible watercraft, said drive mechanism comprising:

a housing,;

a first drive pulley rotatably coupled to said housing, said first drive pulley having an axis of rotation, an entrance point and an exit point;

a pedal assembly rotatably coupled to said housing and operative to rotate said first drive pulley;

a propeller rotatably coupled to said housing by a propeller shaft;

a driven pulley coupled to said propeller shaft for rotatably driving said propeller, said driven pulley having an axis of rotation substantially perpendicular to said axis of rotation of said first drive pulley, said driven pulley having an entrance point and an exit point, said exit point of said driven pulley substantially aligned with said entrance point of said first drive pulley;

an idler pulley coupled to said housing for rotation relative thereto, said idler pulley having an entrance point, an exit point, and an axis of rotation forming an acute angle relative to the axis of rotation of each of said first drive pulley and said driven pulley, said entrance point of said idler pulley substantially aligned with said exit point of said first drive pulley, said exit point of said idler pulley substantially aligned with said entrance point of said driven pulley;

a first drive belt contacting said idler pulley and rotatably coupling said first drive pulley and said driven pulley; and a second drive belt, said pedal assembly further including a second drive pulley and wherein said first drive pulley includes a reduced radius pulley and an enlarged radius pulley, said enlarged radius pulley having an entrance point and an exit point wherein said entrance point of said first drive pulley is the entrance point of said enlarged radius pulley and said exit point of said first drive pulley is the exit point of said enlarged radius pulley, said second drive belt coupling said second drive pulley and said reduced radius pulley.

20. The watercraft of claim 1 wherein said front section is rotatable in one of a clockwise and a counterclockwise direction relative to said center section and wherein said rear section is rotatable in said one of said clockwise and counterclockwise direction relative to said center section.

* * * * *